United States Patent [19]

Sullivan

[11] 3,980,587

[45] Sept. 14, 1976

[54] STRIPPER COMPOSITION

[75] Inventor: Terrence P. Sullivan, Northfield, Minn.

[73] Assignee: G. T. Schjeldahl Company, Northfield, Minn.

[22] Filed: Aug. 16, 1974

[21] Appl. No.: 497,880

[52] U.S. Cl. ..... 252/546; 252/156; 252/153; 252/DIG. 8; 134/38; 134/40

[51] Int. Cl.[2] ..... C11D 3/33

[58] Field of Search ..... 252/156, DIG. 8, 153, 252/546; 134/38, 40, 42

[56] References Cited

UNITED STATES PATENTS

| | | | |
|---|---|---|---|
| 2,662,837 | 12/1953 | Duncan | 252/158 |
| 3,080,262 | 3/1963 | Newman | 252/156 |
| 3,391,084 | 7/1968 | York | 134/40 |
| 3,551,204 | 12/1970 | Bolger et al. | 134/40 X |
| 3,553,143 | 1/1971 | Bauer | 252/156 X |
| 3,839,234 | 10/1974 | Roscoe | 252/153 X |

FOREIGN PATENTS OR APPLICATIONS

| | | | |
|---|---|---|---|
| 536,441 | 1/1957 | Canada | 252/158 |

*Primary Examiner*—Mayer Weinblatt
*Assistant Examiner*—Charles R. Wolfe, Jr.
*Attorney, Agent, or Firm*—Orrin M. Haugen

[57] ABSTRACT

An aqueous solution for alkaline stripping of metallic surfaces having a resist coating on at least a portion of the surface thereof, the resist coating normally being based upon polyvinyl chloride, such as polyvinyl chloride contained in a base emulsion for a photo resist material. The alkaline stripper solution is based upon a mixture of potassium hydroxide and ammonium hydroxide, together with a chelating agent consisting of the sodium salts of ethylenediaminetetraacetic acid, acetic acid, and ethylene glycol monobutyl ether.

3 Claims, No Drawings

STRIPPER COMPOSITION

BACKGROUND OF THE INVENTION

The present invention relates generally to an improved alkaline stripper formulation, and more specifically to such a stripper formulation which may be effectively utilized on metallic surfaces having coatings of polyvinyl chloride base resin thereon. These base resin coatings are widely used as resists for various metal treating operations, such as, for example, in the chemical etching of printed circuitry, employing either flexible or rigid substrates.

In the fabrication of metallic articles which include a metallic layer or sheet disposed upon a substrate, either flexible or rigid, it is frequently desirable to employ an in-line process wherein the metal surface, coated with a photosensitive resist material such as a photosensitive polyvinyl chloride emulsion may be treated by exposure of the material to a certain desired light pattern, and thereafter developing the photosensitive material so as to permit removal of the material from the surface of the metal. Thereafter, following selected removal of the resist, the metal, while disposed on a suitable supporting substrate or base, is normally immersed in a chemical treating solution wherein a second metallic element may be plated onto the exposed metal surface. Alternatively, the exposed metal may be chemically etched and thereby either partially or completely removed. Thereafter, the remaining adherent, non-developed resist must be stripped from the surface of the metal so as to permit completion of the fabrication operation. It will be appreciated, of course, that polyvinyl chloride emulsions may be applied to the surface of a metal without necessarily being photosensitive, with such resists being applied by conventional coating techniques such as silkscreen or other masking techniques to prepare a desired pattern on the metallic surface.

The formulation of the present invention provides a non-foaming solution which permits the stripper material to be handled through conventional spray nozzles, thereby achieving highly efficient production rates with conventional equipment. It has been further found that the formulations of the present invention have exceptionally long shelf life, and also exceptionally long life in a working solution, thereby reducing the requirement of solution replenishing at frequent intervals.

In addition to the use with conventional spray nozzles, the formulations of the present invention have been found to permit long and continuous use of the material through these conventional spray nozzles. This may be accomplished without requiring unusual straining or clarification techniques, inasmuch as the material maintains the removed resist film in solution. Thus, filters and nozzles are not frequently plugged.

Therefore, it is a primary object of the present invention to provide an improved alkaline stripper for use with resist coatings, particularly resist coatings based upon polyvinyl chloride materials.

It is a further object of the present invention to provide an improved alkaline stripper for use with metallic surfaces, selected portions of which are covered with a coating of a resist material.

It is yet a further object of the present invention to provide an improved non-foaming alkaline stripper which is effective for removal of polyvinyl chloride coatings from metallic surfaces.

Other and further objects of the present invention will become apparent to those skilled in the art upon a study of the following specification and appended claims.

DESCRIPTION OF THE PREFERRED EMBODIMENT

In accordance with the preferred embodiments of the present invention, a concentrate is prepared having the following formulation:

| Component | Parts by Weight |
|---|---|
| Alkaline stripper | 15 to 35 |
| Sodium salt of edetic acid (EDTA) | 0.5 to 1.5 |
| Acetic acid | 4 to 12 |
| Ethylene glycol monobutyl ether | 30 to 100 |

The alkaline stripper component comprises a mixture of potassium hydroxide and ammonium hydroxide in a ratio of between about 10:1 to about 50:1 potassium hydroxide to ammonium hydroxide. This stripper component provides the relatively high pH in the area of about 13 for the working solution.

INDIVIDUAL COMPONENTS

A. Alkaline Stripper

As has been indicated above, the alkaline stripper provides the stripping action of the polyvinyl chloride or other resist material, with this stripper component also providing the high pH in the working solutions. The basic alkaline component is, of course, the potassium hydroxide, however it has been found that the addition of ammonium hydroxide increases the stripping rate and also prevents staining of the copper surface. It is desirable in most instances to maintain the concentration of ammonium hydroxide at a level substantially equal to the make-up level. Such ammonium hydroxide additions, of course, may be conducted routinely.

B. Sodium Salt of Ethylenediaminetetraacetic Acid

The sodium salts of ethylenediaminetetraacetic acid, commonly referred to as edetic acid have been found to provide an excellent chelating agent for the stripper solution. Sodium salts of edetic acid are available commercially under the mark "Versene" by the Dow Chemical Corp., of Midland, Mich., as well as others, these commercially available salts being primarily mixtures of di, tri and tetrasodium salts. The tetrasodium salt and the trisodium salt are also useful, with such materials being, of course, commercially available. This material prevents solder re-deposition on the copper surface, and furthermore, assists in maintaining a bright solder surface, with this brightness being maintained both during and after the stripping process.

C. Acetic Acid

Acetic acid is employed in the formulation to polish the surface of the metal, and provide retention for any such polished surface. Acetic acid is particularly effective in the polishing and retention of a polished surface on copper.

D. Ethylene Glycol Monobutyl Ether

Ethylene glycol monobutyl ether is normally employed in the solution to dissolve and maintain in solution, the resist material. Ethylene glycol monobutyl ether accordingly assists in the continuation of the stripping process, and also prevents the frequent plugging of filters and nozzles because of its ability to retain the stripped resist in solution. Ethylene glycol monobutyl ether is, of course, available commercially.

THE WORKING SOLUTION

In a typical working solution, from between about 10 lbs. and 30 lbs. of the formulation set forth above is employed in 100 gallons of water, with a range of from 15 lbs. and 25 lbs. per 100 gallons of water. This achieves a working solution which is particularly effective on copper surfaces. One specific formulation which has been found highly suited for use on copper surfaces in printed circuitry applications is as follows:

| Component | Amount per Gallon of Working Solution |
|---|---|
| Potassium hydroxide | 0.18 lbs. |
| Ammonium hydroxide | 0.01 gallons |
| Sodium salts of edetic acid (Versene) | 0.01 lbs. |
| Acetic acid (glacial) | 0.01 gallons |
| Ethylene glycol monobutyl ether | 0.09 gallons |

As indicated above, this preparation is highly suited for use in treatment of copper surfaces by a spray application through spray nozzles at pressures of 50 psi or more.

Preferably, the working solution is heated to a temperature of between about 120° and 140° F. Such a temperature provides a workable solution which is capable of being handled without unusual precautions being necessary.

For replenishing the solution, one gallon of ethylene glycol monobutyl ether is normally required for each 500 square feet of resist coated copper treated. Such a replenishing schedule has been found to provide effective utilization of the alkaline stripper over an extended period of time. Also, as indicated above, ammonium hydroxide may be added on a substantially continuous basis in order to maintain the concentration at a high level.

In lieu of the mixture of sodium salts of edetic acid employed in the example given, it has been found that the tetrasodium salt provides effective chelating action for the formulation given above. Equal quantities or proportions may be employed.

In lieu of the mixture of sodium salts, or in lieu of the tetrasodium salt, the trisodium salt may also be employed with effective results, this material also being utilized on an equal proportion basis to that provided in the example above.

TECHNIQUE

In order to prepare a working solution, approximately 70% of the overall water requirement is placed in a vessel, to which the ethylene glycol monobutyl ether is added. This combination of components is then mixed thoroughly before addition of potassium hydroxide. Thereafter, potassium hydroxide is added to the solution and mixed whereupon glacial acetic acid is introduced into the vessel. Thereafter, the ammonium hydroxide and sodium salt of edetic acid is added and thereafter the balance of the water is added.

As has been indicated above, the formulation is one which is extremely fast and rapid in its application, and appears to have an exceptional capacity of resist. It will, of course, be appreciated that various changes may be made in the formulation without necessarily departing from the spirit and scope of the present invention.

I claim:

1. The method of stripping a resist coating from the surface of a metallic surface, wherein the resist coating consists essentially of polyvinyl chloride, which method consists essentially of exposing said resist coating to an aqueous working solution of a concentrate, wherein the concentrate has a composition as follows:

| Component | Parts by Weight |
|---|---|
| Alkaline stripper | 15 to 35 |
| Sodium salt of ethylenediamine-tetraacetic acid selected from di, tri, and tetrasodium salts of ethylenediaminetetraacetic acid and mixtures thereof | 0.5 to 1.5 |
| Acetic acid | 4 to 12 |
| Ethylene glycol monobutyl ether | 30 to 100 |

and wherein said concentrate is dispersed in aqueous solution in an amount ranging from between about 10 lbs. per gallon to about 30 lbs. per gallon.

2. The method as defined in claim 1 being particularly characterized in that said alkaline stripper component ratio in said concentrate is approximately 30:1 potassium hydroxide to ammonium hydroxide.

3. The method as defined in claim 1 being particularly characterized in that said concentrate formulation is as follows:

| Component | Parts by Weight |
|---|---|
| Alkaline stripper | 19 |
| Sodium salt of ethylenediaminetetraacetic acid selected from di, tri, and tetrasodium salts of ethylenediaminetetraacetic acid and mixtures thereof | 1 |
| Acetic acid | 8 |
| Ethylene glycol monobutyl ether | 50 to 55. |

* * * * *